US005456989A

United States Patent [19]

Nogami et al.

[11] Patent Number: 5,456,989

[45] Date of Patent: Oct. 10, 1995

[54] PHOTOSENSITIVE BODY FOR ELECTROPHOTOGRAPHY

[75] Inventors: Sumitaka Nogami; Michihiro Kitazawa; Katsuhiro Sato, all of Kawasaki, Japan

[73] Assignee: Fuji Electric Co., Ltd., Kanagawa, Japan

[21] Appl. No.: 347,068

[22] Filed: Nov. 23, 1994

[30] Foreign Application Priority Data

Nov. 24, 1993 [JP] Japan ..... 5-292895

[51] Int. Cl.[6] ..... G03G 5/047

[52] U.S. Cl. ..... 430/59; 430/58

[58] Field of Search ..... 430/58, 59

[56] References Cited

U.S. PATENT DOCUMENTS

| | | | |
|---|---|---|---|
| 4,515,882 | 5/1985 | Mammino et al. | 430/58 |
| 5,162,181 | 11/1992 | Fujimoto et al. | 430/58 |
| 5,312,708 | 5/1994 | Terrell et al. | 430/59 |
| 5,344,733 | 9/1994 | Suzuki et al. | 430/59 |

FOREIGN PATENT DOCUMENTS

| | | |
|---|---|---|
| 423823 | 4/1991 | European Pat. Off. . |
| 456979 | 11/1991 | European Pat. Off. . |
| 62-251757 | 11/1987 | Japan . |
| 63-19659 | 1/1988 | Japan . |
| 63055560 | 3/1988 | Japan . |
| 2222965 | 9/1990 | Japan . |
| 3-58054 | 3/1991 | Japan . |
| 3-102360 | 4/1991 | Japan . |
| 3-157664 | 7/1991 | Japan . |
| 3-211562 | 9/1991 | Japan . |
| 3-211564 | 9/1991 | Japan . |
| 3-211563 | 9/1991 | Japan . |
| 3-211561 | 9/1991 | Japan . |
| 4-122946 | 4/1992 | Japan . |
| 4-338761 | 11/1992 | Japan . |
| 4-335639 | 11/1992 | Japan . |
| 4-331958 | 11/1992 | Japan . |
| 5-61218 | 3/1993 | Japan . |
| 5-61219 | 3/1993 | Japan . |

*Primary Examiner*—Roland Martin

*Attorney, Agent, or Firm*—Spencer, Frank & Schneider

[57] ABSTRACT

A positively charged organic photosensitive body is provided, the photosensitive body being free from public hazards, and being highly sensitive and highly durable. The photosensitive body has a photosensitive layer of a laminated structure on a conductive substrate. The photosensitive layer has a charge transport layer (I) having hole mobility, a charge generation layer, and a charge transport layer (II) containing a curing product of a doped amino resin and having electron mobility. The charge transport layer (I), the charge generation layer, and the charge transport layer (II) are laminated in this order on the conductive substrate. Various suitable substances may be added to the charge transport layer (II), thereby enhancing its durability without deteriorating the photosensitive characteristics.

14 Claims, 1 Drawing Sheet

PHOTOSENSITIVE BODY FOR ELECTROPHOTOGRAPHY

BACKGROUND OF THE INVENTION

1. Field of the Invention

The present invention relates to a photosensitive body for electrophotography and more specifically to an organic photosensitive body for electrophotography which includes a photosensitive layer having a novel structure and which is used in a positively charged state.

2. DESCRIPTION OF PRIOR ART

A photosensitive body for electrophotography (hereinafter may be referred to simply as photosensitive bodys) for use in electrophotographic apparatus that was begun with the invention of Carlson, there have been widely employed photosensitive bodys comprising inorganic photoconductive materials such as selenium, selenium alloys, zinc oxide, and cadmium sulfide. Recently, however, photosensitive bodys comprising organic photoconductive materials have been developed energetically because of their nontoxic nature, film-forming properties, light weights, low prices, and so on. Among them are so-called double-layered laminate type organic photosensitive bodys having a photosensitive layer divided into a charge generation layer for receiving light to generate charge carriers therein, and a charge transport layer for transporting the charge carriers which are generated in the charge generation layer. The photosensitive bodys of this type have many advantages such that their sensitivity can be enhanced markedly by combining the respective layers formed of materials optimal for their functions, and that their spectral sensitivity can be increased in response to the wavelength of exposing light. Thus, they have become the mainstream of development, and their practical use is under way.

Many of the double-layered laminate type organic photosensitive bodys that have now found practical use comprise a charge generation layer and a charge transport layer in this order arranged on a conductive substrate. This layered structure is preferred, because it is advantageous in that the charge generation layer in the form of a thin film with a thickness of 1 μm or less can be protected with the charge transport layer with a film thickness of several tens of micrometers. At the time of image formation, the photosensitive body is usually charged negative on its surface. This is because the charge transfer substance of the charge transport layer now in practical use has hole mobility.

For the purpose of image formation, the surface of the photosensitive body is charged normally by a corona discharge. A corona discharger such as a corotton discharger or a scorotron discharger gives off ozone. Compared with a positively charged surface of the photosensitive body, its negatively charged surface causes an enormous amount of ozone, posing the problem of ozone-associated considerable deterioration of the photosensitive body and the environment. Moreover, an image forming process based on negative charging requires a toner of a positive polarity for developing the image. It is difficult that such a toner of a positive polarity is produced. Even if such toner is produced, it will not have uniform properties.

To resolve the above-mentioned problems, various proposals have been made for organic photosensitive bodys which can be used in a positively charged state. For example, there has been proposed a positively charged photosensitive body with a photosensitive layered structure reverse to that of a conventional negatively charged photosensitive body, i.e., a photosensitive body having a photosensitive layer comprising a charge transport layer having hole mobility, and a charge generation layer arranged on the charge transport layer, the charge generation transport for generating charge carriers when receiving light. However, such a photosensitive body has the charge generation layer exposed on the surface. Thus, it is apt to be affected by ultraviolet radiation during illumination, ozone generated by a corona discharge during charging, and humidity in the surrounding environment. It is also vulnerable to external actions such as mechanical frictions during development, transfer or cleaning. Thus, the electrical characteristics and image characteristics of the photosensitive body degrade noticeably, eventually leading to its poor durability.

To eliminate these drawbacks, it has been proposed to provide on the charge generation layer a protective layer comprising an insulating or conductive transparent resin layer. For instance, Japanese Patent Application Laying-open Nos. 211561-4/1991 propose providing a protective layer containing picric acid, phthalic anhydride, hydrophobic silica and nitrobenzoic acid, respectively, added to a curable silicone resin to impart conductivity. Likewise, Japanese Patent Application Laying-open No. 157664/1991 proposes providing a thin film of diamond as a protective layer by the CVD (Chemical Vapor Deposition) method. These methods forming a protective layer essentially induce a decrease in the sensitivity of the photosensitive body, and pose the problems that too thick a protective layer results in a sharp decrease in sensitivity, while too thin a protective layer exhibits poor function.

Also, a photosensitive body has been proposed as a positively charged photosensitive body, including a charge generation layer and a charge transport layer containing 2,4,7-trinitro-9-fluorenone with high electron mobility which is arranged on the charge generation layer. However, the substance is carcinogenic, and cannot be used actually from the viewpoint of public health. Electron-mobile substances free from carcinogenicity have also been eagerly developed. For example, Japanese Patent Application Laying-open No. 335639/1992 shows an electron-mobile polymer, Japanese Patent Application Laying-open No. 338761/1992 indicates an example of using a cyclic sulfone as an electron-mobile substance, and Japanese Patent Application Laying-open No. 331958/1992 reveals an example of using a cyanoimine as an electron-mobile substance. Japanese Patent Application Laying-open Nos. 61218/1993 and 61219/1993 show examples of using aromatic or vinyl compounds having potent electron attractive groups as electron-mobile substances. These substances, however, have not a little carcinogenicity, and their synthesis is also difficult. Thus, the production of positively charged photosensitive bodys on a commercially feasible scale leaves much to be desired.

Japanese Patent Application Laying-open Nos. 102360/1991, 58054/1991 and 122948/1992 propose single-layered photosensitive bodys comprising pyrylium salts as charge generation substances, and photosensitive layers containing eutectoid complexes of these salts with binder resins. Such photosensitive bodys have the drawback of a high memory effect.

SUMMARY OF THE INVENTION

The present invention has been accomplished in view of the above-mentioned drawbacks of conventional technologies.

An object of the invention is to provide an organic photosensitive body used in a positively charged state, which is free from public hazards, and which is highly sensitive and highly durable.

According to the present invention, the object is attained by providing a photosensitive body having a photosensitive layer formed on a conductive substrate, the photosensitive layer comprising at least a charge transport layer (I), a charge generation layer, and a charge transport layer (II) superimposed in this order on the substrate, the charge transport layer (I) being a layer containing a charge transport substance having hole mobility, and the charge transport layer (II) being a layer containing a curing product of a doped amino resin and having electron mobility.

The above and other objects, effects, features and advantages of the present invention will become more apparent from the following description of embodiments thereof taken in conjunction with the accompanying drawings.

DETAILED DESCRIPTION OF THE INVENTION

Figure 1:
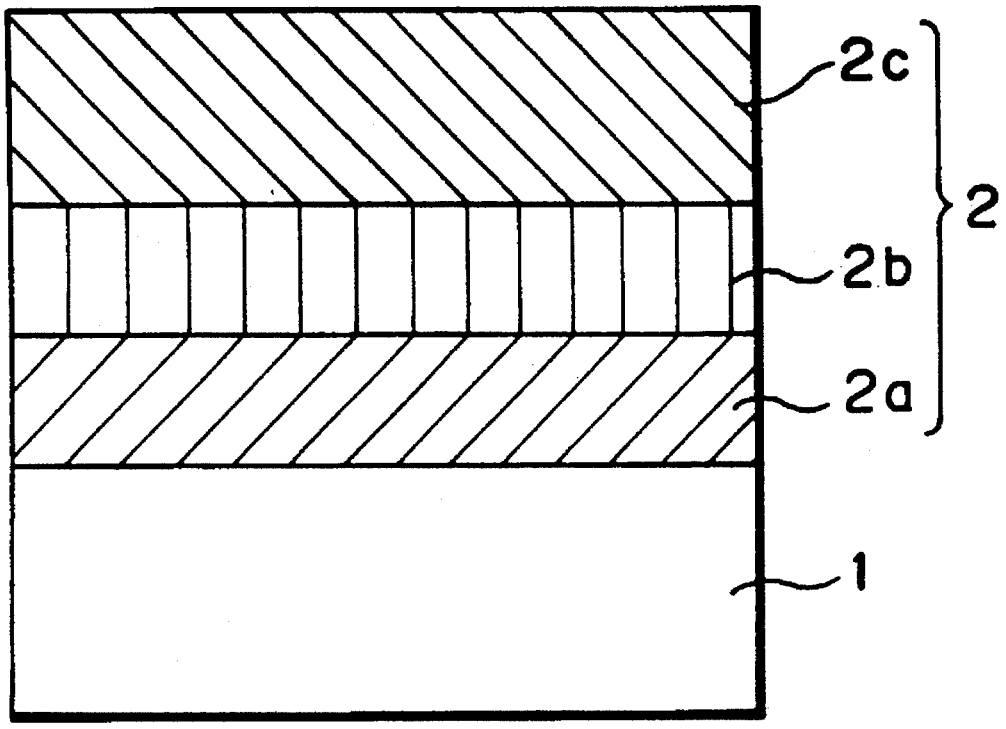
FIG. 1 is a schematic sectional view of one embodiment of a photosensitive body according to the present invention.

The amino resin may be selected from among n-butylated urea resins, n-butylated melamine resins, iso-butylated melamine resins, and n-butylated melamine-benzoguanamine reins.

A dopant for the amino resin may be one substance or a mixture of two or more substances selected from the group consisting of iodine, organic sulfonate compounds, and ferric chloride. For example, naphthalene-2-sulfonic acid or its ammonium salt can be used.

The charge transport layer (II) may contain an antioxidant. The antioxidant may be at least one substance selected from the group consisting of hindered phenols, organic sulfur compounds, organic phosphorus compounds, and phenylenediamines.

Preferably, the charge transport layer (II) contains at least one selected from the group consisting of urethane resins, alkyd resins, acrylic resins, blocked isocyanate compounds, and solvent-soluble fluoroplastics.

The charge transport layer (II) may further contain ultrafine titanium oxide or ultrafine silicon oxide.

The charge transport layer (II) is a cured film formed by adding a dopant, such as iodine, naphthalene-2-sulfonic acid or ferric chloride, to an amino resin to form a charge transfer complex, and adding thereto an inorganic acid or an organic acid as a curing catalyst so that the acid will function as a proton source. This cured film has high electron mobility.

A photosensitive body having a photosensitive layer of the layered structure of the present invention is positively charged on the surface thereof, and light having an absorption wavelength for the charge generation layer is projected. As a result, the charge generation layer generates charge carriers consisting of electrons and holes. The holes are injected into the charge transport layer (I) having hole mobility which is provided on the substrate side of the charge generation layer, and then, the holes move toward the conductive substrate to neutralize the negative charge of the substrate. On the other hand, the electrons are injected into the charge transport layer (II) having electron mobility which is provided on the surface side of the charge generation layer and which contains a curing product of a doped amino resin. Then, the electrons move to the surface of the photosensitive body to neutralize the positive charge of the surface. That is, the photosensitive body of the present invention can be used in a positively charged condition.

The photosensitive body concerned with the present invention will be described in more detail below.

The conductive substrate may be one composed of a known conductive substance. The examples include plates or drums of metals such as aluminum or aluminum alloy, various plastic films or drums sputtered, vacuum-evaporated, or coated with tin oxide or indium oxide, and plastic films or drums containing metal powder, carbon powder, or carbon fibers in dispersed condition.

If desired, the photosensitive body of the present invention, like a conventional photosensitive body, may have between the conductive substrate and the photosensitive layer an adhesive layer of a solvent-soluble nylon, casein, polyvinyl alcohol or butyral resin with a thickness of 0.1 to 2 μm.

The charge transport layer (I) is formed by dissolving an electron donor compound, such as a styryl compound, a carbazole compound, a hydrazone compound, a triarylamine compound or an oxazole compound, in a suitable solvent together with a resin such as a polyester resin, a polystyrene resin, an acrylic resin, a polycarbonate resin or a phenoxy resin, then coating the solution, and drying the coating. If desired, the charge transport layer (I) can be formed by dissolving the above-mentioned electron donor compound in a suitable solvent together with a photosetting resin or a thermosetting resin, such as an acrylate compound or epoxy compound of a polyhydric alcohol, a urethane resin or a melamine resin, then coating the solution, and drying the coating. The thickness of the charge transport layer (I) is 0.1 to 50 μm, preferably 1 to 40 μm.

The charge generation layer is formed by dissolving or dispersing a charge generating substance, such as an azo pigment, a quinone pigment, a perylene pigment, a squarylium pigment or a phthalocyanine pigment, in a suitable solvent together with a resin such as polyvinyl butyral, polystyrene, acrylic resin, polyvinyl chloride, or polyester resin, or a curable resin such as an epoxy resin, a urethane resin or a melamine resin, then coating the solution or dispersion, and drying or curing the coating to form a film. The thickness of the charge generation layer is 0.01 to 5 μm, preferably 0.1 to 2 μm.

The charge transport layer (II) having electron mobility which is provided on the charge generation layer is a layer consisting essentially of a cured product of a doped amino resin. Specifically, this layer is formed by adding iodine, naphthalene-2-sulfonic acid or ferric chloride to a urea resin, an acetoguanamine resin, a benzoguanamine resin, a melamine resin, or a mixture or co-condensation product of any of these resins to form a charge transfer complex, and curing the complex by using as a curing catalyst a proton source, e.g., an inorganic acid such as hydrochloric acid, sulfuric acid, phosphoric acid or nitric acid, or an organic acid such as oxalic acid, acetic acid, adipic acid, benzoic acid, phthalic acid, trimellitic acid, acrylic acid or itaconic acid, thereby forming a cured film. Of course, any of these acids can be used in the form of an acid anhydride or an ammonium salt. Furthermore, an alkyd resin, an acrylic polyol resin, an acrylic carboxylate resin, a phenolic resin, an epoxy resin, a silicone resin, or a urethane resin may be added as a co-condensation resin to the resulting amino resin curing product. Depending on the type or amount of the resin added, the strength, toughness or hardness of the cured film can be controlled arbitrarily. As far as the cured film does not lose transparency for the wavelength of irradiated light, fine particles of titanium oxide, silica, silicone resin or fluoroplastic may be added. To improve the ozone resistance, $NO_x$ resistance and ultraviolet light resistance of the cured film, it is preferred to add an antioxidant or an ultraviolet absorber. Examples of the antioxidant are hindered phenolics, hydroquinones, arylamines, phenylenediamines, organic sulfur compounds, organic phosphorus compounds, L-ascorbic acids, and glutaric acids which are used alone or in suitable combinations.

The doped amino resin curing product related to the present invention will be described in further detail below.

The amino resin is prepared by reacting a urea compound such as dicyandiamide, urea, thiourea, ethyleneurea, dihydroxyethyleneurea or triazone, or a triazine compound such as melamine, isomelamine, benzoguanamine, acetoguanamine or guanylmelamine, with formaldehyde to convert it into a methylol compound, and reacting the methylol compound with an alcohol to etherify it. The alcohol in common use includes, for example, an oil-soluble one such as n-butanol or isobutanol, or a water-soluble one such as methanol or ethanol. Amino resins have long been used in large amounts as paints, adhesives, and fiber treating agents. Depending on their applications and purposes of use, a great many types have been developed. By changing their amounts reacted with aldehydes, acidity during condensation, reaction temperature, reaction time, etc. in various manners, wide varieties of amino resins, such as those with high to low molecular weights, those with high to low degrees of etherification, or co-condensation products of ureas and melamines, can be obtained and are commercially available. In the present invention, any of these products can be used. The cured film of doped amino resin in the present invention is formed by adding a dopant and a curing agent to a solution of any of these resins, forming the mixture into a film, and heating and curing the film. As the dopant is used iodine, ferric chloride or organic sulfonate as stated hereinabove. Desirably, iodine is used in an amount of 1 to 10 parts with respect to 100 parts of the amino resin, and ferric chloride is also used in an amount of 1 to 10 parts based on 100 parts of the amino resin. Examples of the organic sulfonate used are aromatic and alicyclic sulfonic acids, such as p-toluenesulfonic acid, dodecylbenzenesulfonic acid, naphthalenesulfonic acid, and camphorsulfonic acid. Any of these sulfonic acids is used desirably in an amount of 6 to 50 parts with respect to 100 parts of the amino acid. As the curing agent for curing the amino acid, protons based on the aforementioned dopants, such as iodic acid, hydrochloric acid and sulfonic acid, can act as curing agents by themselves. Generally, however, it is desirable that an acid as a proton source be added as a curing catalyst for accelerating curing. Examples of the acid usable are inorganic acids such as hydrochloric acid, sulfuric acid, nitric acid or phosphoric acid, and organic acids such as oxalic acid, acetic acid, succinic acid, azelaic acid, adipic acid, acrylic acid, methacrylic acid, itaconic acid, endomethylenetetrahydrophthalic acid, tetrahydrophthalic acid, benzoic acid, phthalic acid, isophthalic acid, trimellitic acid, or pyromellitic acid. Any of these acids is desirably used in an amount of 1 to 20 parts with respect to 100 parts of the amino resin. Of course, these acids can be used in the form of acid anhydrides or ammonium salts.

The cured film of doped amino resin basically contains the amino resin, the dopant and the proton source as essential components. When the cured film of doped amino resin is to be used as a charge transport layer having electron mobility, various additives may be added in order to improve the film-forming properties, the adhesion to the charge generation layer, the ozone resistance and $NO_x$ resistance, or the wear resistance. For the improvement of the film-forming properties or the film strength, there may be added an acrylic resin, an alkyd resin, a urethane resin, a polyvinyl acetal, a silicone resin, a thermosetting silicone resin, a thermosetting urethane resin, or a blocked isocyanate compound. Any of these substances may be added in an amount of 0.1 to 100 parts with respect to 100 parts of the amino resin. For the improvement of the ozone resistance or the $NO_x$ resistance, the aforementioned antioxidant is desirably added. Examples of the antioxidant include hindered phenols such as dibutylhydroxytoluene, 2,2'-methylenebis(6-t-butyl-4-methylphenol), 4,4'-thiobis(6-t-butyl-3-methylphenol) or α-tocopherol, hydroquinone compounds such as 2,5-di-t-octylhydroquinone, 2,6-didodecylhydroquinone, or 2-t-octyl-5-methylhydroquinone, arylamines such as diphenylamine, triphenylamine or N,N'-dimethylphenylamine, phenylenediamines such as N-phenyl-N'-isopropyl-p-phenylenediamine, N,N' -di-sec-butyl-p-phenylenediamine, or N,N'-dimethyl-N,N'-di-t-butyl-p-phenylenediamine, organic sulfur compounds such as dilauryl-3,3'-thiodipropionate or distearyl-3,3'-thiodipropionate, and organic phosphorus compounds such as triphenylphosphine or tricresylphosphine. These antioxidants are used alone or in combination each in an amount of 5 to 30 parts with respect to 100 parts of the amino resin.

The charge transport layer (II) is formed by dissolving the above amino resin and various additives in a solvent, applying the solution onto the charge generation layer by dip coating or spray coating, and heating the coating for 10 to 60 minutes at a temperature of 100° to 140° C. for baking and curing. The thickness of the film formed is set at 1 to 30 μm. If desired, an intermediate layer may be provided between the charge generation layer and the charge transport layer (II) in order to improve the adhesion of these layers, the intermediate layer made of materials such as polyvinyl butyral, vinyl chloride copolymer, or alcohol-soluble nylon. The thickness of the intermediate layer is desirably 0.01 to 1.0 μm.

DETAILED DESCRIPTION OF PREFERRED EMBODIMENTS

The present invention will now be illustrated in greater detail with reference to the following examples, but it should be understood that these examples are not to be construed as limiting the embodiments of the present invention.

FIG. 1 is a schematic sectional view of one embodiment of a photosensitive body according to the present invention. The photosensitive body has a conductive substrate 1 and a photosensitive layer 2 provided on the conductive substrate 1. The photosensitive layer 2 has a charge transport layer (I) 2*a*, a charge generation layer 2*b*, and a charge transport layer (II) 2*c* laminated in this order on the conductive substrate 1.

EXAMPLE 1

The outside surface of an aluminum alloy cylinder with an outside diameter of 60 mm, an inside diameter of 58 mm and a length of 230 mm was dip-coated with a solution comprising 10 parts by weight of a hydrazone compound of the formula shown below, 10 parts by weight of a polycarbonate resin (UPIRON PCZ-300, a product of Mitsubishi Gas Chemical Co., Inc.), and 80 parts by weight of tetrahydrofuran to form a charge transport layer (I) with a dry-basis thickness of 20 μm.

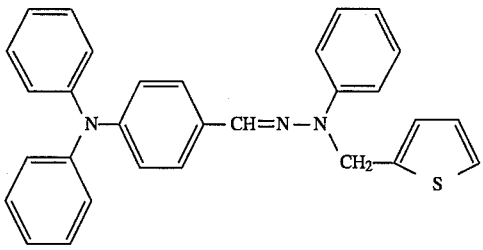

Then, 2.1 parts by weight of an azo compound expressed by the formula shown below, and 1.0 part by weight of a polyvinyl acetal (ESLEX KS-1, a product of Sekisui Chemical Co., Ltd.) were dispersed by a sand mill together with 16 parts by weight of methyl ethyl ketone, and 9 parts by weight of cyclohexanone, followed by further adding 75 parts by weight of methyl ethyl ketone, to prepare a coating fluid. The coating fluid was dip-coated onto the charge transport layer (I) to form a charge generation layer with a dry-basis thickness of 0.1 μm.

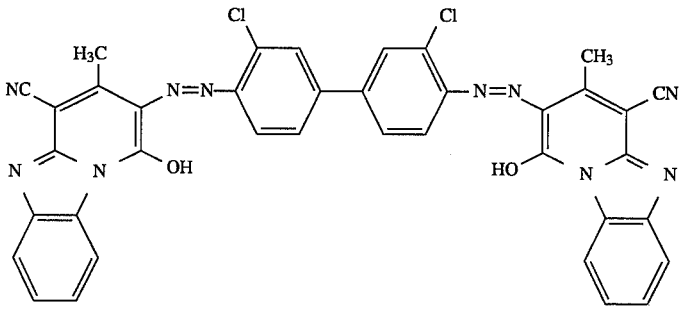

Then, 100 parts by weight of a melamine resin (UBAN 20HS, a product of Mitsui Toatsu Chemicals, Inc.), 5 parts by weight of iodine, 4 parts by weight of acrylic acid, 5 parts by weight of a blocked isocyanate (BARNOC D500, a product of Dainippon Ink and Chemicals, Inc.), 10 parts by weight of an acrylic polyol resin (ACRYDIC A-166, a product of Dainippon Ink and Chemicals, Inc.), and 10 parts by weight of 2,2'-methylenebis(6-t-butyl-4-methylphenol) as an antioxidant were added to tetrahydrofuran to prepare 20% by weight of a coating fluid. The coating fluid was applied onto the charge generation layer, and dried. The coating was baked for 15 minutes at a temperature of 140° C. to form a charge transport layer (II) consisting essentially of a curing product of the doped amino resin with a film thickness of 10 μm. Thus was produced a photosensitive body.

The so produced photosensitive body was introduced in a commercially available electrophotographic copying machine (DC-1205, a product of Mita Industrial Co., Ltd. ), and a potential measuring probe was mounted on its development zone. A black paper potential, $V_B$, a light paper potential, $V_L$, and a half decay exposure (the quantity of exposure required to decrease the initial potential from 700 V to 350 V, expressed as lux.sec), $E_{1/2}$, were measured. Further, a running test for performing a series of steps, i.e. charging, exposure, development, transfer, and cleaning, was repeated 10,000 times with this copying machine, whereafter the black paper potential $V_B$, the light paper potential $V_L$, and the half decay exposure $E_{1/2}$ were measured. The results are shown in Table 1.

TABLE I

| | $V_B$ (V) | $V_L$ (V) | $E_{1/2}$ (lux · sec) |
|---|---|---|---|
| Initial stage | 700 | 15 | 1.2 |
| After 10,000 running tests | 650 | 30 | 1.3 |

As shown in Table 1, the photosensitive body of Example 1 exhibited satisfactory characteristics both at the initial stage and after the 10,000 running tests, thus proving to be an excellent photosensitive body enough usable as a positively charged photosensitive body.

EXAMPLES 2 to 14

Photosensitive bodys of Examples 2 to 14 were produced in the same way as in Example 1, except that the coating fluid for forming the charge transport layer (II) was changed to have the formulation shown in Tables 2 and 3, and that the film thickness was set at 10 μm.

TABLE 2

| | Amino resin | Resin added | Dopant | Curing agent | Antioxidant | Filler |
|---|---|---|---|---|---|---|
| Ex. 2 | UBAN 10S-60 | BARNOC D550 | Iodine (5) | Adipic acid (5) | 2,6-di-t-butyl-4-methylphenol (10) | None |

TABLE 2-continued

| | Amino resin | Resin added | Dopant | Curing agent | Antioxidant | Filler |
|---|---|---|---|---|---|---|
| | (100) | (10) | | | | |
| Ex. 3 | UBAN 20SB (100) | BARNOC D550 (10) | Iodine (5) | Adipic acid (5) | 2,6-di-t-butyl-4-methylphenol (10) | None |
| Ex. 4 | UBAN 2020 (100) | BARNOC D550 (10) | Naphthalene-sulfonic acid (25) | Trimellitic acid (5) | 2,6-di-t-butyl-4-methylphenol (10) | None |
| Ex. 5 | UBAN 2020 (100) | FLUONAT EK-700 (10) | Naphthalene-sulfonic acid (25) | Trimellitic acid (5) | N,N'-diphenyl-p-phenylenediamine (10) | None |
| Ex. 6 | UBAN 62 (100) | ACRYDIC A-310 (10) | Naphthalene-sulfonic acid (25) | Trimellitic acid (5) | N,N'-diphenyl-p-phenylenediamine (10) | None |
| Ex. 7 | UBAN 62 (100) | OLESTAR L-2284 (10) | Naphthalene-sulfonic acid (25) | Trimellitic acid (5) | N,N'-diphenyl-p-phenylenediamine (10) | None |
| Ex. 8 | UBAN 20HS (100) | FLUONAT E K-700 (10) | Iodine (5) | Ammonium phthalate (8) | N,N'-di-2-naphthyl-p-phenylenediamine (10) | TTO-55 (A) (10) |

Numerals in the parentheses in the table represent the amounts (parts by weight) of the respective components.

TABLE 3

| | Amino resin | Resin added | Dopant | Curing agent | Antioxidant | Filler |
|---|---|---|---|---|---|---|
| Ex. 9 | UBAN 20HS (100) | BARNOC D550 (10) | Ammonium naphthalenesulfonate (30) | Ammonium phthalate (8) | Tris(nonylphenyl)-phosphite (10) | ADMAFINE S0-C2 (10) |
| Ex. 10 | UBAN 20 HS (100) | FLUONATE K-700 (10) | Ammonium naphthalenesulfonate (30) | Ammonium phthalate (8) | N,N'-diphenyl-p-phenylenediamine (10) | ADMAFINE S0-C2 (10) |
| Ex. 11 | UBAN 20HS (100) | FLUONATE K-700 (10) | Ferric chloride (5) | Ammonium phthalate (8) | N,N'-diphenyl-p-phenylenediamine (10) | ADMAFINE S0-C2 (10) |
| Ex. 12 | UBAN 91-55 (100) | OLESTAR L-2284 (10) | Naphthalene-sulfonic acid (25) | None | N,N'-diphenyl-p-phenylenediamine (10) | None |
| Ex. 13 | UBAN 91-55 (100) | FLUONATE K-700 (10) | Naphthalene-sulfonic acid (25) | None | N,N'-diphenyl-p-phenylenediamine (10) | None |
| Ex. 14 | UBAN 91-55 (100) | BARNOC D550 (10) | Naphthalene-sulfonic acid (25) | None | N,N'-diphenyl-p-phenylenediamine (10) | None |

Numerals in the parentheses in the table represent the amounts (parts by weight) of the respective components.

COMPARATIVE EXAMPLES 1 and 2

Photosensitive bodys of Comparative Examples 1 and 2 were produced in the same way as in Example 1, except that the coating fluid for forming the charge transport layer (II) was changed to have a dopant-free formulation as shown in Table 4, and that the film thickness was set at 10 μm.

EXAMPLES 15 to 18

Photosensitive bodys of Examples 15 to 18 were produced in the same way as in Example 1, except that the coating fluid for forming the charge transport layer (II) was changed to have a formulation with a low dopant content.

TABLE 4

| | Amino resin | Resin added | Dopant | Curing agent | Antioxidant | Filler |
|---|---|---|---|---|---|---|
| Comp. Ex. 1 | UBAN 20HS (100) | None | None | Adipic acid (5) | N,N'-diphenyl-p-phenylenediamine (10) | None |
| Comp. Ex. 2 | UBAN 20HS (100) | None | None | Trimellitic acid (5) | N,N'-diphenyl-p-phenylenediamine (10) | None |
| Ex. 15 | UBAN 20HS (100) | None | Naphthalene-sulfonic acid (5) | Trimellitic acid (5) | N,N'-diphenyl-p-phenylenediamine (10) | None |
| Ex. 16 | UBAN 20HS (100) | None | Naphthalene-sulfonic acid (5) | Ammonium phthalate (8) | N,N'-diphenyl-p-phenylenediamine (10) | None |
| Ex. 17 | UBAN 2011S (100) | None | Naphthalene-sulfonic acid (5) | Ammonium phthalate (8) | N,N'-diphenyl-p-phenylenediamine (10) | None |
| Ex. 18 | UBAN 20HS (100) | None | Naphthalene-sulfonic acid (5) | Oxalic acid (4) | N,N'-diphenyl-p-phenylenediamine (10) | None |

Numerals in the parentheses in the table represent the amounts (parts by weight) of the respective components.

The names of the amino resins, the resins added, and the fillers in Tables 2, 3 and 4 are the trade names at their manufacturers, and represent the following:

Amino resins (all are products of Mitsui Toatsu Chemicals, Inc.):

UBAN 10S-60: n-Butylated urea resin

UBAN 20SB: n-Butylated melamine resin

UBAN 20HS: n-Butylated melamine resin

UBAN 2020: n-Butylated melamine resin

UBAN 62: iso-Butylated melamine resin

UBAN 91-55: n-Butylated melaminebenzoguanamine co-condensation resin

Resins added (all are products of Dainippon Ink and Chemicals, Inc.):

BARNOC D550: Blocked isocyanate

FLUONATE K-700: Hydroxyl-containing fluorocarbon resin of the solution type

ACRYDIC A-310: Acrylic resin

OLESTAR L-2284: Thermoplastic urethane elastomer

Fillers:

TTO-55 (A): Rutile type ultrafine titanium oxide (a product of Ishihara Sangyo Kaisha Ltd.)

ADMAFINE SO-C2: Ultrafine silicon oxide (a product of Kabushiki Kaisha Tatsumori)

The photosensitive bodys of these Examples 2 to 18 and Comparative Examples 1 and 2 were each evaluated for their characteristics in the same manner as in Example 1. The results are shown in Tables 5 and 6, respectively.

TABLE 5

| | Characteristics of photosensitive body | | | | | |
|---|---|---|---|---|---|---|
| | Initial stage | | | After 10,000 running tests | | |
| | $V_B$ (V) | $V_L$ (V) | $E_{+e,fra\ 1/2}$+ee (lux · sec) | $V_B$ (V) | $V_L$ (V) | $E_{+e,fra\ 1/2}$+ee (lux · sec) |
| Ex. 2 | 690 | 20 | 1.2 | 680 | 30 | 1.4 |
| Ex. 3 | 680 | 18 | 1.1 | 650 | 28 | 1.5 |
| Ex. 4 | 700 | 21 | 1.0 | 690 | 30 | 1.4 |
| Ex. 5 | 710 | 25 | 0.9 | 700 | 35 | 1.3 |
| Ex. 6 | 715 | 28 | 1.1 | 700 | 38 | 1.4 |
| Ex. 7 | 680 | 15 | 1.2 | 650 | 39 | 1.6 |
| Ex. 8 | 685 | 10 | 1.4 | 660 | 18 | 1.9 |
| Ex. 9 | 715 | 20 | 1.6 | 700 | 24 | 2.1 |
| Ex. 10 | 700 | 21 | 1.2 | 690 | 29 | 1.9 |
| Ex. 11 | 700 | 24 | 1.4 | 695 | 30 | 2.3 |
| Ex. 12 | 705 | 28 | 1.1 | 700 | 35 | 1.4 |
| Ex. 13 | 697 | 14 | 1.0 | 690 | 30 | 1.8 |
| Ex. 14 | 699 | 13 | 1.3 | 680 | 29 | 1.6 |

TABLE 6

| | Characteristics of photosensitive body | | | | | |
|---|---|---|---|---|---|---|
| | Initial stage | | | After 10,000 running tests | | |
| | $V_B$ (V) | $V_L$ (V) | $E_{+e,fra\ 1/2}$+ee (lux · sec) | $V_B$ (V) | $V_L$ (V) | $E_{+e,fra\ 1/2}$+ee (lux · sec) |
| Comp. Ex. 1 | 730 | 300 | 6.9 | 700 | 400 | — |
| Comp. Ex. 2 | 750 | 310 | 8.0 | 710 | 450 | — |
| Ex. 15 | 710 | 200 | 4.0 | 680 | 300 | 8.0 |
| Ex. 16 | 730 | 210 | 4.2 | 700 | 310 | 7.9 |
| Ex. 17 | 750 | 230 | 5.0 | 710 | 290 | 8.5 |
| Ex. 18 | 700 | 190 | 3.8 | 650 | 320 | 7.5 |

As shown in Tables 5 and 6, the photosensitive bodys of Examples 2 to 18 having the charge transport layer (II) containing the curing product of the doped amino resin have in higher elctroconductivity than those of Comparative Examples 1 and 2 having the charge transport layer (II) containing the curing product of the undoped amino resin. Further, comparing with Comparative Examples 1 and 2, the photosensitive bodys of Examples 2 to 18 exhibit satisfactory photosensitive characteristics $V_L$ and $E_{1/2}$ both at the initial stage and after the 10,000 running tests when positively charged.

Examples using naphthalenesulfonic acid as a dopant with little doping content exhibit unsatisfactory $V_L$ and $E_{1/2}$ values both at the initial stage and after 10,000 running tests when positively charged, compared with the other Examples.

In Examples using organic sulfonic acid as a dopant, it is found that the dopant is preferably added in an amount of 6 to 50 parts with respect to 100 parts of the amino resin.

According to the present invention, the photosensitive layer provided on the conductive substrate at least comprises the charge transport layer (I) having hole mobility, the charge generation layer, and the charge transport layer (II) containing the curing product of the doped amino resin and having electron mobility, the three layers being superposed on the conductive substrate in this order. A photosensitive body having such a photosensitive layer shows satisfactory characteristics, high sensitivity and high durability in a positively charged condition, and thus can be used sufficiently as a positively charged, organic photosensitive body. Since it consists essentially of a curing product of an amino resin, it poses no public hazards such as carcinogenicity.

Furthermore, the charge transport layer (II) to serve as the surface layer of the photosensitive body may have various substances incorporated therein, thereby enhancing its durability without deteriorating the photosensitive characteristics. Thus, there is no need to further provide a protective layer on the charge transport layer (II). For example, antioxidants such as hindered phenols, organic sulfur compounds, organic phosphorus compounds, and phenylenediamines may be added, whereby the ozone resistance and the $NO_x$ resistance can be improved. By adding urethane resins, alkyd resins, acrylic resins, blocked isocyanate compounds, and solvent-soluble fluoroplastics, moreover, the adhesion, the film-forming properties, and the mechanical strength of the film can be improved. Also, ultrafine titanium oxide and ultrafine silicon oxide may be added as fillers.

The present invention has been described in detail with respect to preferred embodiments, and it will now be that changes and modifications may be made without departing from the invention in its broader aspects, and it is the intention, therefore, in the appended claims to cover all such changes and. modifications as fall within the true spirit of the invention.

What is claimed is:

1. A photosensitive body for electrophography, comprising:

a conductive substrate, a charge transport layer (I) arranged on the conductive substrate, the charge transport layer (I) including a charge transport substance having hole mobility, a charge generation layer arranged on the charge transport layer (I), and a charge transport layer (II) arranged on the charge generation layer, the charge transport layer (II) including a charge transport substance having electron mobility, wherein the charge transport layer (II) includes a cured product of an amino resin doped by a dopant.

2. A photosensitive body as claimed in claim 1, wherein the charge transport layer (II) contains as a curing catalyst an acid which serves as a proton source.

3. A photosensitive body as claimed in claim 1, wherein the amino resin is a resin selected from the group consisting of n-butylated urea resins, n-butylated melamine resins, iso-butylated melamine resins, and n-butylated melamine-benzoguanamine reins.

4. A photosensitive body as claimed in claim 1, wherein the dopant is one substance or a mixture of two or more substances selected from the group consisting of iodine, organic sulfonic acid compounds, and ferric chloride.

5. A photosensitive body as claimed in claim 4, wherein the dopant is naphthalene-2-sulfonic acid or its ammonium salt.

6. A photosensitive body as claimed in claim 1, wherein the charge transport layer (II) contains an antioxidant.

7. A photosensitive body as claimed in claim 6, wherein the antioxidant contains at least one substance selected from the group consisting of hindered phenols, organic sulfur compounds, organic phosphorus compounds, and phenylenediamines.

8. A photosensitive body as claimed in claim 1, wherein the charge transport layer (II) contains as a resin added at least one substance selected from the group consisting of urethane resins, alkyd resins, acrylic resins, blocked isocyanate compounds, and solvent-soluble fluoroplastics.

9. A photosensitive body as claimed in claim 1, wherein the charge transport layer (II) contains ultrafine titanium oxide or ultrafine silicon oxide as a filler.

10. A photosensitive body as claimed in claim 3, wherein the dopant is one substance or a mixture of two or more substances selected from the group consisting of iodine, organic sulfonic acid compounds, and ferric chloride.

11. A photosensitive body as claimed in claim 10, wherein the charge transport layer (II) contains as a curing catalyst an acid which serves as a proton source.

12. A photosensitive body as claimed in claim 11, wherein the charge transport layer (II) contains an antioxidant.

13. A photosensitive body as claimed in claim 12, wherein the charge transport layer (II) contains as a resin added at least one substance selected from the group consisting of urethane resins, alkyd resins, acrylic resins, blocked isocyanate compounds, and solvent-soluble fluoroplastics.

14. A photosensitive body as claimed in claim 13, wherein the charge transport layer (II) contains ultrafine titanium oxide or ultrafine silicon oxide as a filler.

* * * * *